United States Patent [19]

Sumiyoshi

[11] 4,020,867

[45] May 3, 1977

[54] MULTIPLE PRESSURE COMPENSATED FLOW CONTROL VALVE DEVICE OF PARALLEL CONNECTION USED WITH FIXED DISPLACEMENT PUMP

[75] Inventor: Toshinari Sumiyoshi, Yokohama, Japan

[73] Assignee: Nisshin Sangyo Kabushiki Kaisha, Tokyo, Japan

[22] Filed: Feb. 24, 1976

[21] Appl. No.: 661,051

Related U.S. Application Data

[63] Continuation of Ser. No. 500,470, Aug. 26, 1974, abandoned.

[52] U.S. Cl. ..... 137/596.13; 91/414; 91/420; 91/433; 91/446; 137/596.2

[51] Int. Cl.[2] ..... F15B 13/08

[58] Field of Search ..... 91/412, 414, 420, 433, 91/446; 137/117, 498, 501, 596.12, 596.13, 596.2

[56] References Cited

UNITED STATES PATENTS

| | | | |
|---|---|---|---|
| 2,497,032 | 2/1950 | Millard | 137/498 X |
| 2,865,397 | 12/1958 | Chenault | 137/501 |
| 3,823,734 | 7/1974 | McJones | 137/498 |
| 3,841,096 | 10/1974 | Koppen et al. | 91/414 X |
| 3,882,896 | 5/1975 | Budzich | 91/446 X |

*Primary Examiner*—Alan Cohan
*Assistant Examiner*—Gerald A. Michalsky
*Attorney, Agent, or Firm*—Wenderoth, Lind & Ponack

[57] ABSTRACT

A multiple control valve device for connection in parallel between a single fixed displacement pump and one or more oil actuators to control operation of all or a number of the actuators simultaneously. The pump can supply sufficient oil at an optimum pressure which is the highest loading pressure required among the working actuators. At the same time the desired controlled oil flow rate can be held to the desired value for each working actuator by this device. Also this valve device has stepless speed changing control, provides a self-depressing function of pump pressure loading, and can also have the function that a pressure rise or a pressure variation in the actuators can be treated automatically.

2 Claims, 12 Drawing Figures

FIG. 8 PRIOR ART
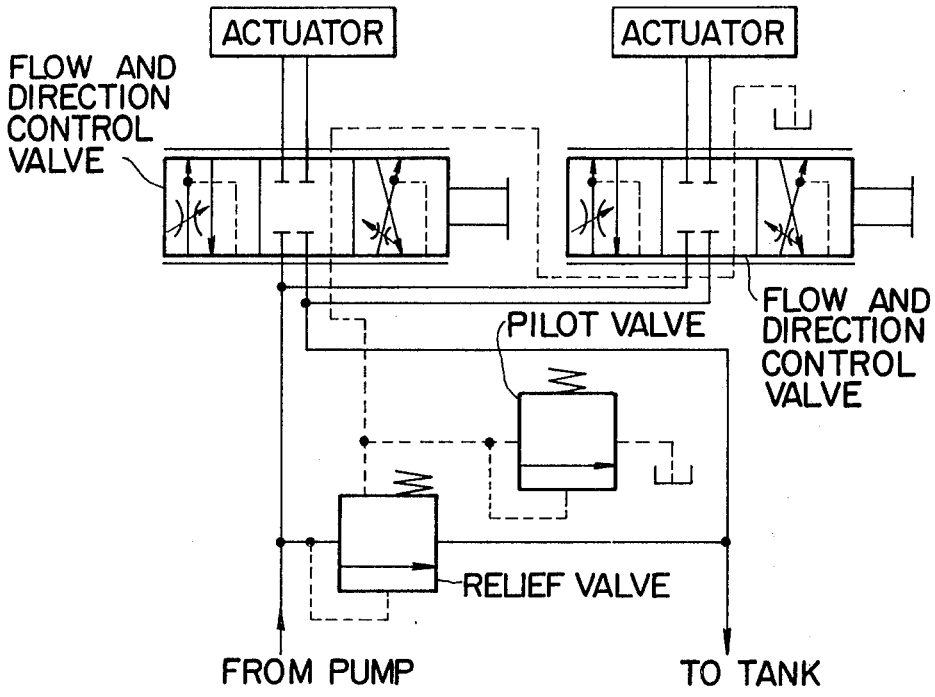
FIG. 11 PRIOR ART
FIG. 10 PRIOR ART
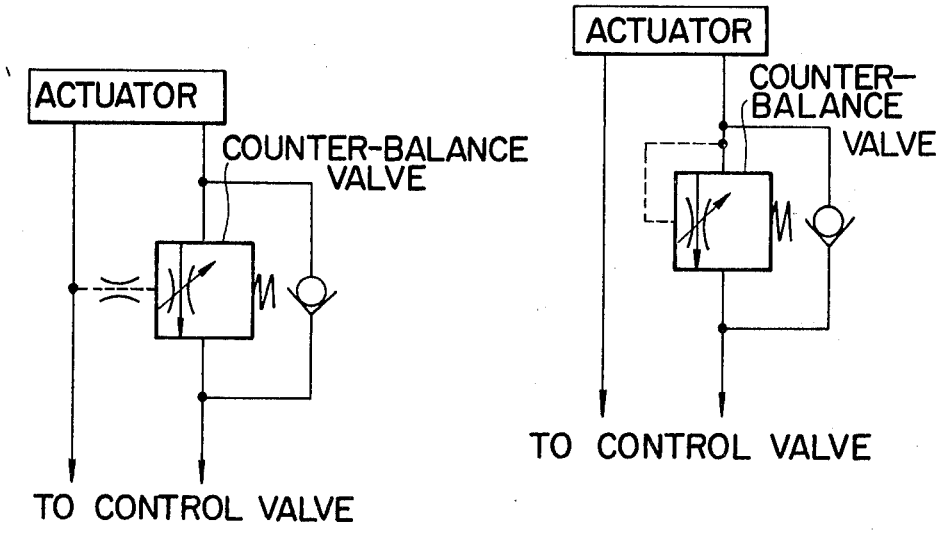

MULTIPLE PRESSURE COMPENSATED FLOW CONTROL VALVE DEVICE OF PARALLEL CONNECTION USED WITH FIXED DISPLACEMENT PUMP

This is a continuation of application Ser. No. 500,470, filed Aug. 26, 1974, now abandoned.

BACKGROUND OF THE INVENTION

1. Field of the Invention

This invention relates to a control valve device having control valves connected in parallel between one fixed displacement pump and many oil actuators to control and drive the actuators.

2. Description of the Prior Art

Pressure compensated flow control valves connected in parallel with one fixed displacement pump have been used, e.g., such valves as shown in the diagrams in FIG. 8 and FIG. 9, but they have not yet been found to be satisfactory for use because of the following points.

In a device such as shown in FIG. 8, when all directional valves are in neutral position, pilot oil pressure at the spring side of the relief valve is exhausted to the oil tank and the pump discharge oil pushes the relief valve spool against the spring to open the relief valve and to discharge all the flow to the oil tank. When any one of the directional valves is in an operating position, the working pressure thereof acts on the spring side of the relief valve to move it in the closing direction so as to increase the pump discharge pressure. But when more than one of the directional valves are in operating positions, pilot pressure acting on the relief valve tends to be the average working pressure of the operating directional valves, and it becomes difficult to hold the pump discharge at the highest required pressure, and flows to valves requiring lower pressure tend to increase above the desired flow rate because of higher pump discharge pressure. Therefore regular simultaneous operation is impossible.

In a device such as shown in FIG. 9, as the pilot pressure on the spring side of the spool of the relief valve there is selected, through a shuttle valve, the highest pressure among the working pressures of the operating control valves. Of this highest pressure, only the operating control valve with the highest working pressure can operate regularly, and other operating valves are fed with higher pressure than each requires. Therefore additional manual control operation is necessary to lower the higher pressure supplied to the respective required pressures, and the desired flow rate cannot be held automatically if the working pressure varies. Consequently regular simultaneous operation is also impossible in this case.

In another arrangement of such a control device, a counter balance valve as shown in the diagrams of FIG. 10 and FIG. 11 can be added to accomodate a pressure rise and pressure variation which occurs in the return passage from the oil actuator. An external pilot type valve is shown in FIG. 10, and it operates in response to a pressure variation in feed passage to the control valve from the actuator to produce an opposite variation in the passage with the valve in it, and the operation is delayed and becomes a source of troublesome hunting action. A satisfactory valve of this type is nothing new. An internal pilot type valve is shown in FIG. 11 and it operates in response to pressure variation in the return passage from the actuator to the control valve in which the control valve itself is located so as to open the counter balance valve when the pressure increases. Hunting action does not occur with this arrangement, but the pressure rise in the return passage is added to the pump pressure loading to increase power consumption, and this type of counter balance valve is not usually used.

SUMMARY OF THE INVENTION

The principal purpose of this invention is to provide a control valve device which can supply oil to one or more oil actuators with a different pressure at each, and which can hold a desired control flow rate to the actuators automatically when a different pressure exists at each.

Another purpose of this invention is to provide a control valve device which can automatically act to treat an extra-ordinarypressure rise in the return passage from the actuator to the control valve.

The control device of this invention provides directional valves with restrictors in numbers corresponding to the number of actuators, the valves and restrictors being hydraulically connected in parallel, supply passages from a pump, discharge and return passages to and from the actuators, an outlet passage to a tank, first and second compensating valves, and pilot pressure passages with check valves therein, and a leak valve, all as described below. The device can also further have a third pressure compensating valve.

The first pressure compensating valves, each have a spool which moves so that the pressure difference across the restrictors in the directional valve is balanced against a spring force. First pressure compensating valves are connected in the supply passages of the directional valves respectively, and are normally open and act automatically to stay in the position where the pressure difference is equal to the spring force. Because of the property of liquid that the flow rate does not vary where there is an equal pressure difference along the flow path even if there are pressure changes in it, the flow rate through the directional valves at a fixed opening of the restrictor can be maintained constant for any pressure variation with this device. This pressure compensating valve opens as the pressure difference becomes large and closes as it becomes small.

The second pressure compensating valve has a spool which moves so that the pressure difference between the pump supply pressure and the highest working pressure among working directional valves is balanced against a spring force. It is connected in a bypass from the supply conduit of the pump to the return conduit, and is normally closed. It acts automatically to stay at the position where the pressure difference is equal to the spring force required to maintain the pressure difference constant so that flow rate through the directional valve with highest working pressure will remain constant regardless of any pressure change, and can maintain the pressure and flow rate required in all working directional valves by bypassing residual oil to the return conduit even when several directional valves are working simultaneously.

In the directional valves which are working under a lower pressure than the directional valve working at the highest pressure, the first pressure compensating valve thereof automatically throttles the flow to maintain the desired flow rate for the respective working pressures, thus acting as pressure reducing valves, so oil at the proper working pressure can be fed to each such directional valve, and simultaneous operation of all controllers at the optimum pressure can be carried out.

A first pressure compensating valve is provided for each directional valve, while a common second pressure compensating valve is provided for all the directional valves. Pilot pressure oil is directed to the spring side of the spool of the second pressure compensating valve, which oil constantly leaks slightly through a pressure compensating leak valve to the return conduit to the tank. When all directional valves are in a neutral position, so that the pilot pressure oil passage is in full closed condition, the pilot pressure decreases suddenly even though there is only a slight leakage through the leak valve, because of the non-compressibility of the liquid, and the second pressure compensating valve therefore opens fully even at a low pump discharge pressure, thereby bypassing all of the oil to the tank. The leak valve being pressure compensated, it always opens only slightly to leak only a small volume of oil under any pressure change in the pilot line, so that actually there is little oil power loss. This also smoothes pilot pressure changes, reduces troublesome hunting action which often occurs in such a pressure compensating control valve, and can make the whole valve construction simple. That is, when such a leak valve is not used, the pilot pressure passage construction necessary to exhaust the pilot pressure to a drain or a conduit to the tank when all directional valves are in neutral position would be very complex, and such a complex passage construction and the tendency toward sudden pressure change also requires a complex structure to suppress hunting.

This device can have added thereto a device to function as a counter balance valve. In this case, a third pressure compensating valve similar to the first one in construction and function is connected in the outlet passages of each of the directional valves. When a pressure rise occurs in the return passages, the flow rate through the return and outlet passages is regulated as desired in the same way as the first pressure compensating valves. By adding the third pressure compensating valves, counterbalance action takes place both in the normal and the reverse positions of the directional valves, so that double counterbalance valves are present.

When using a third pressure compensating valve for the situations when the actuator acts as a pump, a switching cylinder can be attached to the spool of the third pressure compensating valve to keep some desired pressure in the feed passage to the actuator to prevent troublesome cavitation that may occur in the feed passage to actuator when decreased pressure occurs. The switching cylinder normally causes the third pressure compensating valve to close, and when pressure in the inlet passage rises to some desired pressure, it releases the spool and the third pressure compensating valve becomes normally open the same as the first one.

While it is not possible where multiple valves are used, when only one directional valve is used, the first pressure compensating valve can be omitted.

The control valve device of this invention, when used in a hoisting winch, a traverser winch, an oil hydraulic car, a robot system etc., makes it possible to operate one or more actuator or motors simultaneously with any load pressure variation to secure the desired control speed steplessly, yet with lower oil power consumption and an inexpensive single fixed displacement oil pump. Troublesome hunting action is avoided. Also a good counterbalance valve has been provided for the first time by this invention.

BRIEF DESCRIPTION OF THE DRAWINGS

FIGS. 8 and 9 are diagrams of known control valve device constructions; and

FIGS. 10 and 11 are diagrams of known counterbalance valves.

DESCRIPTION OF THE PREFERRED EMBODIMENTS

Figure 1:
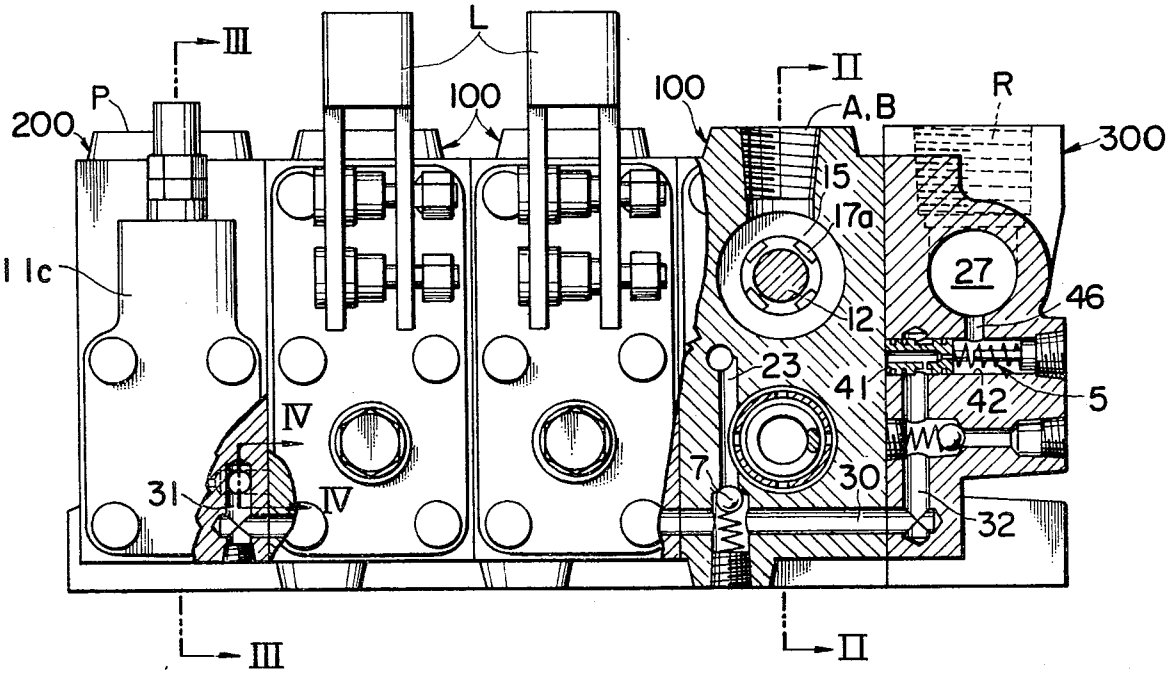
FIG. 1 is a front elevation, partially cut away, of a practical example of a control valve device according to the invention.

A practical embodiment of a valve device according to the invention and as shown in FIGS. 1 through 6 consists of a plurality of units 100 provided with directional valves 1A, 1B, 1C, first pressure compensating valves 2A, 2B, 2C, and check valves 6 and 7. On one end of the plurality of units 100 is a unit 200 provided with a second pressure compensating valve and a pilot valve for a safety valve and on the other end of the plurality of units 100 is a unit 300 provided with a pressure compensated leak valve. Units 100 can be attached in a line and there can be as many as the number of actuators used. An oil pump is connected to port P in unit 200, oil actuators are connected to ports A and B in units 100, and port R in unit 300 can be connected to an oil tank or to port P of another such device as this.

Figure 2:
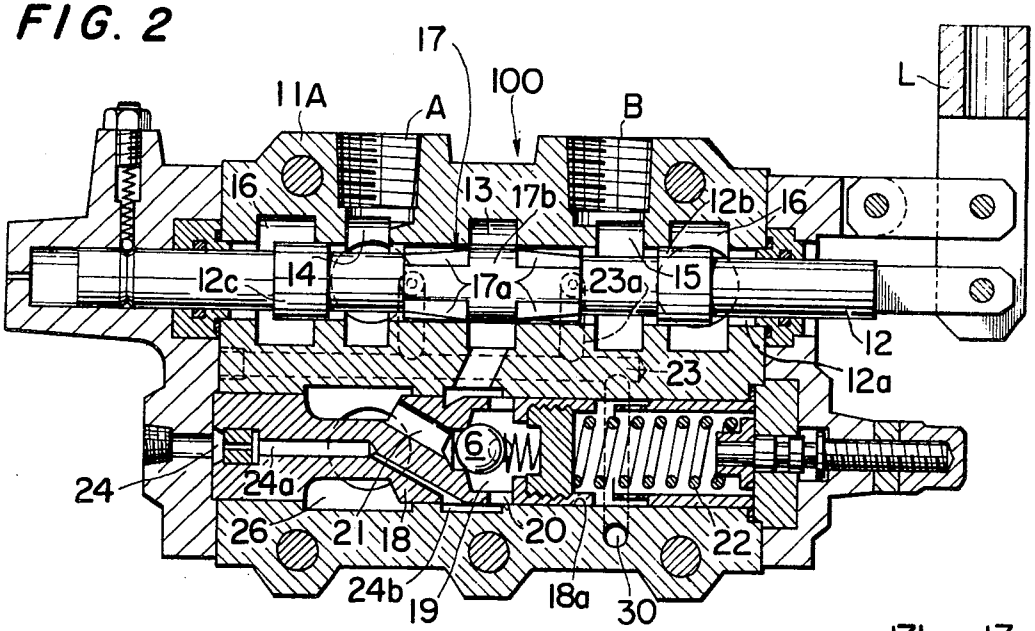
FIG. 2 is a section taken along line II—II in FIG. 1.
Figure 2A:
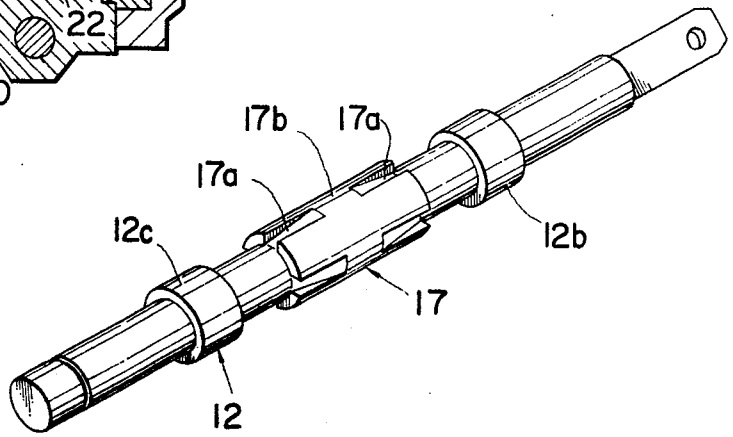
FIG. 2*a* is a perspective view of the spool of FIG. 2.

As shown in FIG. 2, each directional valve has a valve member 12 which can slide in bore 12*a* in housing 11A under the action of a mechanism such as the lever and linkage generally indicated at L. The valve member can connect oil passages provided in housing 11A with each other by being moved to the proper position. The figure shows the valve member in the neutral position. When the valve member moves to the right, passage 13 is connected to passage 14 which is connected to port A for an actuator. Passage 15 which is connected to port B for an actuator is connected to passage 16 due to movement of spool 12*b*, respectively. When the valve member moves to the left, passage 13 is connected to passage 15 and passage 14 is connected to passage 16 due to movement of spool 12*c*, respectively. During such sliding movement, the area of the space within the bore 12*a* between passages 13 and 14 or 13 and 15 is varied by variable restrictor 17. The restrictor 17 cooperates with the front edges of passage 13 and the bore 12*a* for the valve member, and is a spool member having tapered grooves 17*a* extending in opposite directions from the central portion 17*b* along the spool. Grooves 17*a* have enlarging sectional areas in the directions toward passages 14 and 15. Thus the area of bore 12 at passage 13 filled by the restrictor 17 decreases as the valve member slides to the right or to the left from the neutral position, so that the flow from passage 13 past the restrictors increases gradually the farther the valve member moves.

To secure the desired flow rate with a constant pressure difference across the restrictor 17, a first pressure compensating valve is provided in housing 11A. Valve body 18 of the valve is movable in a bore 18*a* in housing 11A and has a chamber 19 inside the valve body.

Restrictor openings 20 are provided around chamber 19 in valve 18. Coil spring 22 pushes the valve body 18 to leave restrictor openings 20 normally in the open condition. A pilot passage 23 opens into the portion of bore 18*a* in which the coil spring is positioned, and has secondary passages 23*a* opening into the bore 12*a* adjacent the restrictor 17 on the directional valve. The difference between the pressure in passage 14 or 16 and the pressure in spaces 24, 24*a* and 24*b* around valve body 18 acts on valve body 18 through the secondary and pilot passages 23*a* and 24 and the valve body 18 stays at a position at which the pressure difference balances the spring force of spring 22 to keep the pressure difference between opposite sides of restrictor 17 constant with automatically changing area of restrictor openings 20.

Figure 3:
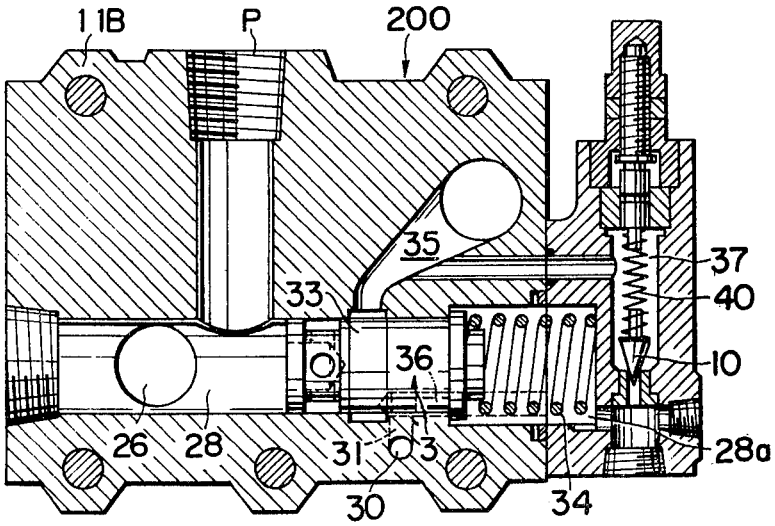
FIG. 3 is a section taken along line III—III in FIG. 1.

Passages 16 in unit 100 are connected to passage 27 in unit 300, and passage 26 is connected to passage 28 in unit 200 as shown in FIG. 3. Pilot passage 23 in unit 100 is connected to passage 30 through check valve 7 constructed with a ball and spring, pilot passages 30 in units 100 are connected to each other and their one ends are connected at one end of the units 100 to passage 31 in unit 200 and at the other end to passage 32 in unit 300 respectively.

Figure 4:
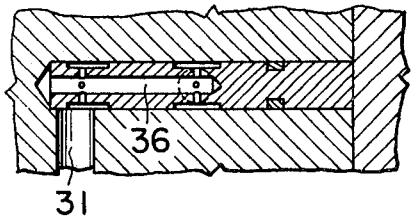
FIG. 4 is a partial section, on an enlarged scale, taken along line IV—IV in FIG. 1.

The highest pressure in passage 14 or 15 among any one of units 100 is lead to the chamber 28*a* in the second pressure compensating valve 3 in unit 200 having spring 34 therein through passages 23, 30 and 31 after pushing open check valve 7 in passage 23. At the same time check valves in other units 100 are closed because of the higher pressure in said unit 100. The pilot pressure is thus selected as the highest load pressure and is sent to the second pressure compensating valve. Valve body 33 of the second pressure compensating valve, as shown in FIG. 3, is positioned in a bore 28 to which is connected passage 26 from units 100. The valve body 33 is loaded by the coil spring 34 to close lateral passage 35 extending from bore 28 by means of the body 33 so that the valve is normally closed. Passage 31 connected to the pilot pressure passages 23 in units 100 is provided with fixed restrictor orifice 36 as shown in FIG. 4. This orifice acts as a buffer to prevent sudden pilot pressure changes, but finer adjustment of it is not necessary because of the natural stable function of the invention as compared with known devices. Pilot valve 10 in unit 200, which controls safe valve action, opens when the pilot pressure rises higher than normal to lower the pressure and suddenly opens the second pressure compensating valve to make it act as a safety valve.

Figure 5:
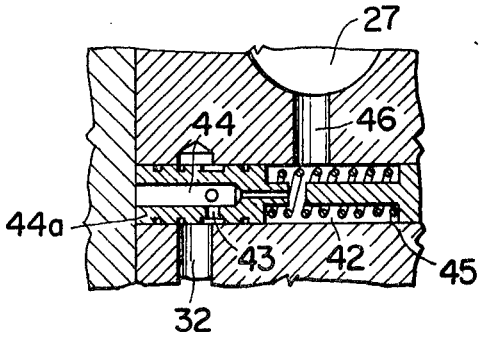
FIG. 5 is a partial section, on an enlarged scale, showing details of a leak valve for the pilot passage in the valve device of FIG. 1.

A pressure compensated leak valve 5 in unit 300, as shown in FIG. 5, is a restrictor valve which is normally open to leak oil from passage 32 through passages 43, 44 and 46. When the pressure in passage 30 increases, pressure on the left side of spool 44*a* increases due to the increased pressure in passage 32 to move spool 44*a* toward right in bore 42 against force of spring 45, reducing the size of the opening 43 to maintain the quantity of oil leaking out at the higher pressure substantially the same, but when pressure in passage 30 decreases, the opening 43 becomes wider so that substantially the same quantity of oil leaks out at all times. Leaked oil is lead to low pressure part 27 of return port R through passage 46, or it may be lead to a drain.

Figure 6:
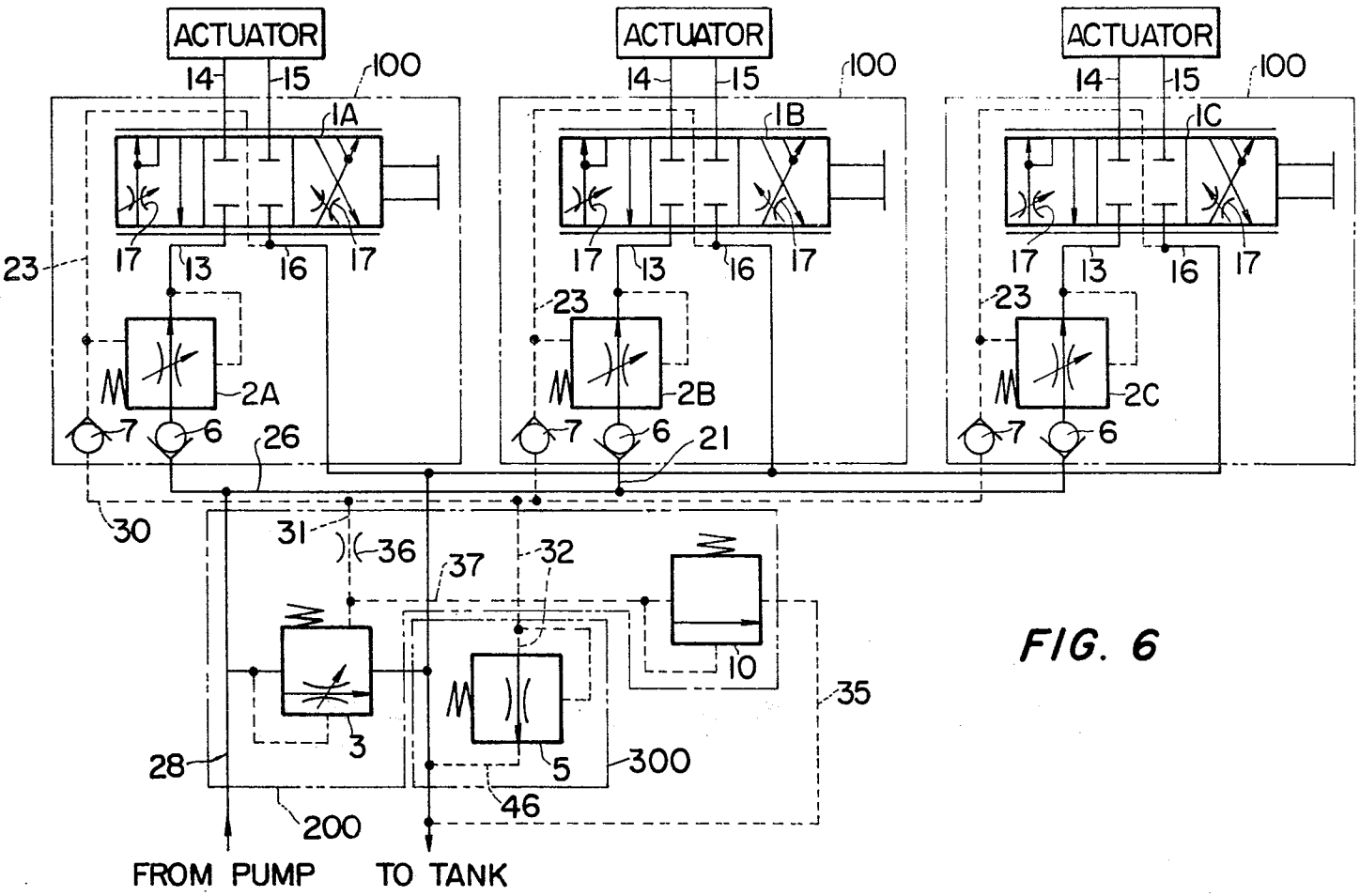
FIG. 6 is a diagram of the valve device of FIG. 1.

FIG. 6 is a diagram of the oil circuit for the valve device described above. Reference numbers in FIG. 6 correspond to those in FIGS. 1 through 5. The operation will be described with reference to FIG. 6.

When the spools 12 of directional valves 1A, 1B, 1C of units 100 are all in the neutral position as shown in FIG. 2, passages 14 and 15 are closed by spools 12 to close the passages to the actuators, and passages 23 are also closed by spools 12, so that pressure in the passages decreases due to oil leakage through passage 30 and leak valve 5, then pump discharge pressure moves valve body 33 of the second pressure compensating valve 3 to connect passages 28 and 35 so that pumped oil flows back to the oil tank through passage 35.

When only one of the directional valves is moved to a working position, for example spool 12 of directional valve 1A moves to the right to connect passage 13 to passage 14 and passage 15 to passage 16 respectively, because only the actuator connected to directional valve 1A is operating, oil in passage 13 flows to the actuator through restrictor 17 and passage 14. As oil flows from passage 13 to passage 14, the pressure difference between passages 13 and 14 which are ahead of and behind restrictor 17, relative to the direction of flow of oil, moves valve body 18 of the first pressure compensating valve to adjust the pressure difference across restrictor 17 so that it is constant. Valve body 33 of the second pressure compensating valve 3 moves in the closing direction to maintain pressure in pilot passage 23 but to permit small leakage of oil through valve 5 to return to passage 27. As the actuator is loaded and the load varied, the first and the second pressure compensating valves automatically function as described above.

Next, when two or all directional valves move to working positions simultaneously, actuators are fed with oil at the required pressure as described above. At this time, pilot pressure in passage 30 becomes the pressure in passage 14 or 15 of the actuator among the working actuators loaded with the highest pressure. The oil pump is loaded through second compensating valve 3 to secure this necessary pressure, and at each working directional valve the required load pressure and desired flow rate are secured for the individual directional valve by removing residual oil by means of the respective first pressure compensating valves, so that the individual directional valves can operate normally and simultaneously without trouble. In other words, the first pressure compensating valves act as pressure reducing valves for such actuators which are working under lower pressure than the pump supply pressure.

When in any one of the working actuators the pressure in the pilot passage 23 increases above the maximum limit, the pressure acts to open check valve 7 and to open pilot valve 10 through passage 30, and the pressure is relieved. As a result pressure in chamber 28*a* of the second pressure compensating valve 3 is suddenly decreased, so that valve body 33 rapidly opens and a relatively large amount of oil is discharged to the tank circuit through passage 35 from pump circuit 28.

Speed control of the actuators is accomplished by moving spools 12 of the directional valves to change the area around restrictors 17, which operation establishes the flow rate for the actuator changes and speed changes.

Figure 7:
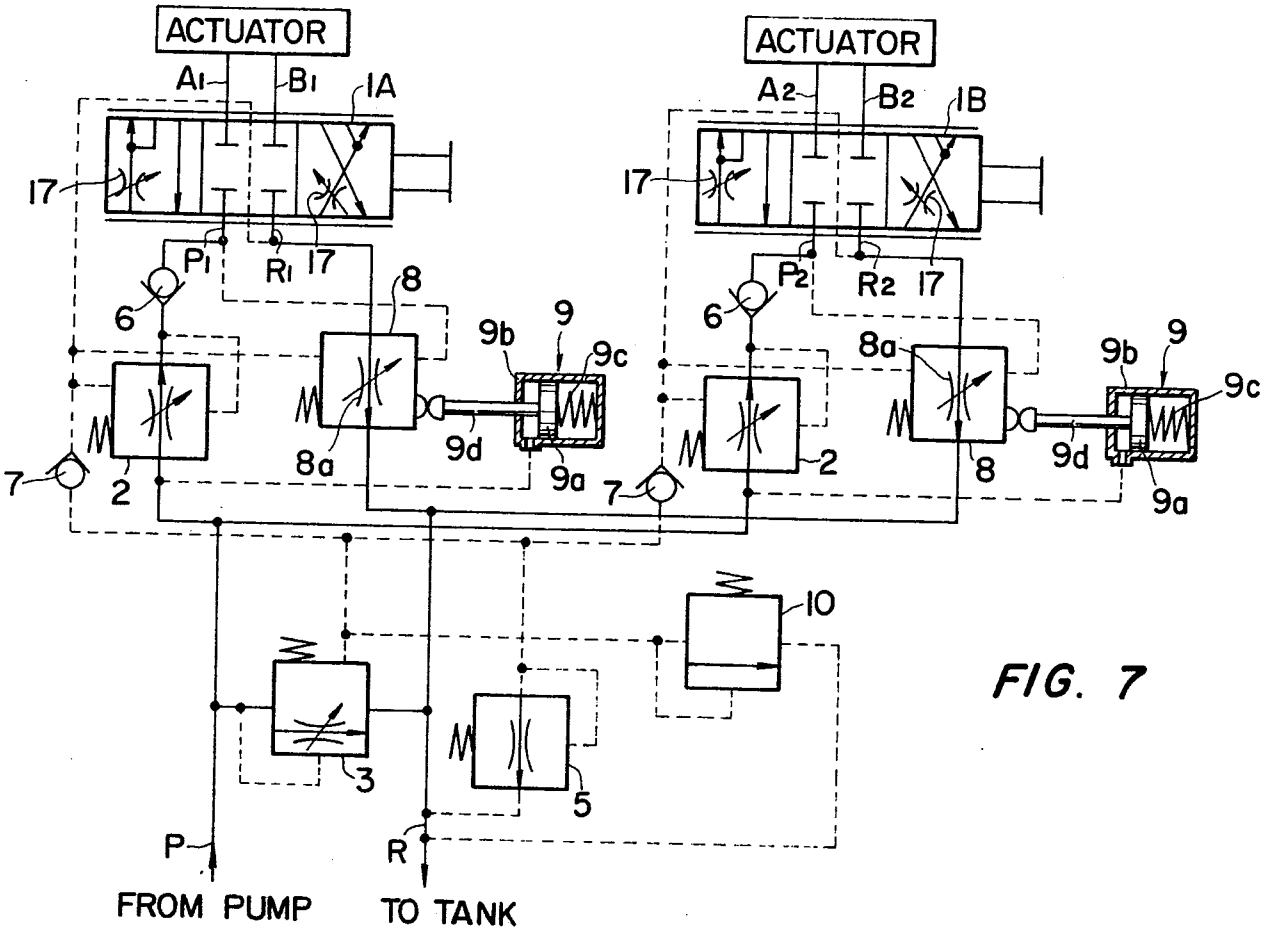
FIG. 7 is a diagram of another embodiment of a control valve device according to the invention.
Figure 9:
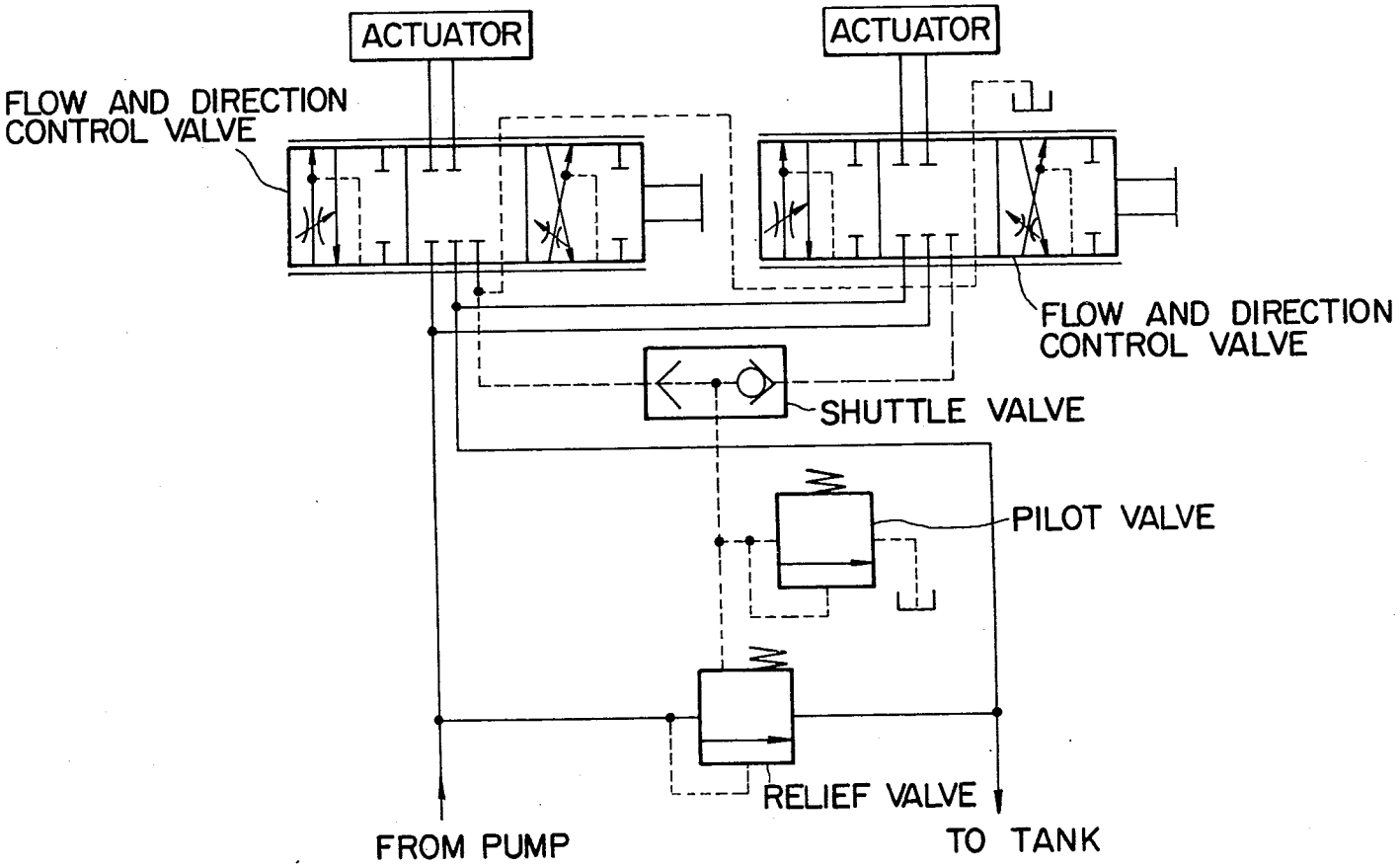
FIG. 9 PRIOR ART

FIG. 7 is a diagram showing a modified valve device according to the invention. In this example for the purpose of adding a counterbalance function, a third pressure compensating valve 8 and a switching cylinder 9 are added to each directional valve 1A, 1B, etc., of the embodiments of FIGS. 1–6. Of course if it is not necessary to have the counterbalance valve function, valve 8 and switching cylinder 9 can be omitted.

The third pressure compensating valve 8 is connected between outlet port $R_1$ or $R_2$ of the directional valve and outlet port R of the overall control device. The valve 8 is provided with a spool having a restrictor 8*a* similar to restrictors 17 which is normally open but which is closed when it is pushed by piston rod 9*a* under the effect of spring 9*c* acting from one end of switching cylinder 9. But when the valve 8 is closed and pressure in the pump port P increases, this pressure acts through conduit 9*e* on the piston rod side of piston 9*a* against spring 9*c* force rod 9*d* to disengage from the spool of valve 8, so that valve 8 moves to its normally open condition the same as valve 2. Therefore with this switching cylinder, the pump pressure can be kept higher than desired for actuator operation to prevent cavitation that might occur from a vacuum in the pump line. Check valve 6 is used to prevent counter flow in line 13 when high pressure is present for the same reason it is used with known counterbalance valves. Thus, cavitation which might occur in an actuator line can be prevented and continuity of flow is secured, so that the function of the third pressure compensting valve is carried out.

If only one directional valve is used, the first pressure compensating valve 2 can be omitted and only the second pressure compensating valve 3 need be used with the valve 8 and switching cylinder 9, etc. The switching cylinder 9 can be omitted when pressure in the pump line is otherwise maintained.

What is claimed is:

1. A control valve device for controlling the flow of pressure liquid to a plurality of hydraulic actuators from a single hydraulic pump, each actuator having a supply line and a return line and the pump having a supply line, and there being a storage tank to which there is a return line and from which the pump draws liquid, said control valve device comprising a plurality of directional valve units each having a directional valve adapted to be connected in parallel between the pump supply line and the respective supply and return lines of the actuators and between the respective supply and return lines of the actuators and the return line, a plurality of first pressure compensating valves, one coupled to each directional and having means for adjusting the opening thereof in response to the pressure difference across the corresponding directional valve, a second pressure compensating valve unit having a single second pressure compensating valve therein adapted to be coupled between the pump supply line and the return line for bypassing said directional valves, pilot pressure sensing means coupled between each directional valve and said second pressure compensating valve for conveying liquid under the pressure in the directional valve to said second pressure compensating valve for adjusting the position of said second pressure compensating valve, check valves in said pilot pressure sensing means associated with each directional valve whereby only the liquid under pressure in the highest pressure directional valve is transmitted to said second pressure compensating valve, a pressure compensated leak valve coupled to said pilot pressure sensing means for bleeding a slight amount of liquid under pressure from said pilot pressure sensing means at all times said leak valve comprising valve means for passing less fluid the greater the pilot pressure, a plurality of third pressure compensating valves, one coupled to each directional valve and adapted to be coupled to said return line and having means for adjusting the opening thereof in response to the pressure difference across the corresponding directional valve, and switching cylinders adapted to be coupled to said pump supply line and operably coupled with said third pressure valves for normally urging said third pressure valves to close and for being disconnected from said third pressure valves when the pressure in the pump supply line rises above a predetermined value.

2. A control valve device for controlling the flow of pressure liquid to a plurality of hydraulic actuators from a single hydraulic pump, each actuator having a supply line and a return line and the pump having a supply line, and there being a storage tank to which there is a return line and from which the pump draws liquid, said control valve device comprising a plurality of directional valve units each having a directional valve adapted to be connected in parallel between the pump supply line and the respective supply and return lines of the actuators and between the respective supply and return lines of the actuators and the return line, a plurality of first pressure compensating valves, one coupled to each directional valve and having means for adjusting the opening thereof in response to the pressure difference across the corresponding directional valve, a second pressure compensating valve unit having a single second pressure compensating valve therein adapted to be coupled between the pump supply line and the return line for bypassing said directional valves, pilot pressure sensing means coupled between each directional valve and said second pressure compensating valve for conveying liquid under the pressure in the directional valve to said second pressure compensating valve for adjusting the position of said second pressure compensating valve, check valves in said pilot pressure sensing means associated with each directional valve whereby only the liquid under pressure in the highest pressure directional valve is transmitted to said second pressure compensating valve, and a pressure compensated leak valve having a cylinder therein with an outlet therefrom to said return line, a spring loaded hollow piston slidable in said cylinder at a point spaced from said oulet and having a leak bore extending longitudinally therethrough, said leak valve further having a lateral passage opening into said cylinder from said pilot pressure sensing means, and said piston having a lateral passage opening into the hollow thereof and cooperating with said first mentioned lateral passage for opening and closing said first mentioned lateral passage during movement of said piston against said spring loading, whereby a slight amount of liquid is bled under pressure from said pilot pressure sensing means at all times and said leak valve passing less fluid the greater the pilot pressure.

* * * * *